US009630075B1

(12) United States Patent
Wallace

(10) Patent No.: US 9,630,075 B1
(45) Date of Patent: Apr. 25, 2017

(54) GOLF CLUB COVER

(71) Applicant: Jason Wallace, Gill, MA (US)

(72) Inventor: Jason Wallace, Gill, MA (US)

( * ) Notice: Subject to any disclaimer, the term of this patent is extended or adjusted under 35 U.S.C. 154(b) by 0 days.

(21) Appl. No.: 14/848,438

(22) Filed: Sep. 9, 2015

(51) Int. Cl.
*A63B 55/00* (2015.01)

(52) U.S. Cl.
CPC ..... *A63B 55/007* (2013.01); *A63B 2209/08* (2013.01)

(58) Field of Classification Search
CPC .... A63B 60/62; A63B 55/007; A63B 2209/08
USPC ..... 150/160; 206/315.2
See application file for complete search history.

(56) References Cited

U.S. PATENT DOCUMENTS

| | | | | | |
|---|---|---|---|---|---|
| 2,508,525 | A | | 5/1950 | Le Fevre | |
| 2,526,985 | A | * | 10/1950 | Whitehead | A63B 60/62 150/160 |
| 2,908,307 | A | | 10/1959 | Kohls | |
| 3,023,795 | A | | 3/1962 | Denkert | |
| 3,145,749 | A | | 8/1964 | Rosenow | |
| 3,593,769 | A | * | 7/1971 | Spears | A63B 60/62 150/160 |
| 3,861,434 | A | * | 1/1975 | Harding | A63B 60/62 150/160 |
| 3,965,955 | A | * | 6/1976 | Price | A63B 60/62 150/160 |
| 5,005,624 | A | | 4/1991 | Sung | |
| 5,246,108 | A | | 9/1993 | Nusbaum | |
| D359,785 | S | | 6/1995 | Kent | |
| 5,437,320 | A | | 8/1995 | Sung | |
| 5,769,141 | A | * | 6/1998 | Rinehard | A63B 60/62 150/160 |
| D509,553 | S | | 9/2005 | Loomis | |
| 7,686,047 | B2 | | 3/2010 | Hooley | |
| 2003/0056866 | A1 | * | 3/2003 | Sheppard, Jr. | A45C 3/12 150/160 |
| 2006/0201596 | A1 | * | 9/2006 | Hwang | A63B 60/62 150/160 |
| 2007/0068611 | A1 | * | 3/2007 | Hwang | A63B 60/62 150/160 |
| 2007/0261772 | A1 | * | 11/2007 | Chow | A63B 60/62 150/160 |
| 2008/0047639 | A1 | * | 2/2008 | Fox | A24F 13/22 150/160 |
| 2013/0213538 | A1 | * | 8/2013 | Gaffney | A63B 55/007 150/160 |
| 2014/0202603 | A1 | * | 7/2014 | Huang | A63B 60/62 150/160 |

FOREIGN PATENT DOCUMENTS

| | | |
|---|---|---|
| CN | 2922956 | 7/2007 |

* cited by examiner

*Primary Examiner* — Sue A Weaver

(57) ABSTRACT

The golf club cover is a cover adapted for use with golf clubs. The golf club cover is designed to protect both the head and the shaft of the golf club. In order to more appropriately pad and protect the shaft, the golf club cover opens into two segments that can be wrapped around the head of the club and wrapped tightly around the shaft of the club. Once properly placed on the golf club, the golf club cover is held in position using a plurality of magnets. The golf club cover comprises a head piece, an elastic band, and a shaft padding.

3 Claims, 4 Drawing Sheets

GOLF CLUB COVER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

The present invention relates to the field of protective covers made from a flaccid material, more specifically, a cover configured for use with a golf club.

A golf club is an expensive piece of athletic equipment and owners often protect them with golf club covers. A common type of golf club cover is formed from an elastic textile which is stretched to cover the head of the club but that provides no real padding or other protection to the shaft. This shortcoming of the golf club cover is addressed in this disclosure.

SUMMARY OF INVENTION

The golf club cover is a cover adapted for use with golf clubs. The golf club cover is designed to protect both the head and the shaft of the golf club. In order to more appropriately pad and protect the shaft, the golf club cover opens into two segments that can be wrapped around the head of the club and wrapped tightly around the shaft of the club. Once properly placed on the golf club, the golf club cover is held in position using a plurality of magnets.

These together with additional objects, features and advantages of the golf club cover will be readily apparent to those of ordinary skill in the art upon reading the following detailed description of the presently preferred, but nonetheless illustrative, embodiments when taken in conjunction with the accompanying drawings.

In this respect, before explaining the current embodiments of the golf club cover in detail, it is to be understood that the golf club cover is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the golf club cover.

It is therefore important that the claims be regarded as including such equivalent construction insofar as they do not depart from the spirit and scope of the golf club cover. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
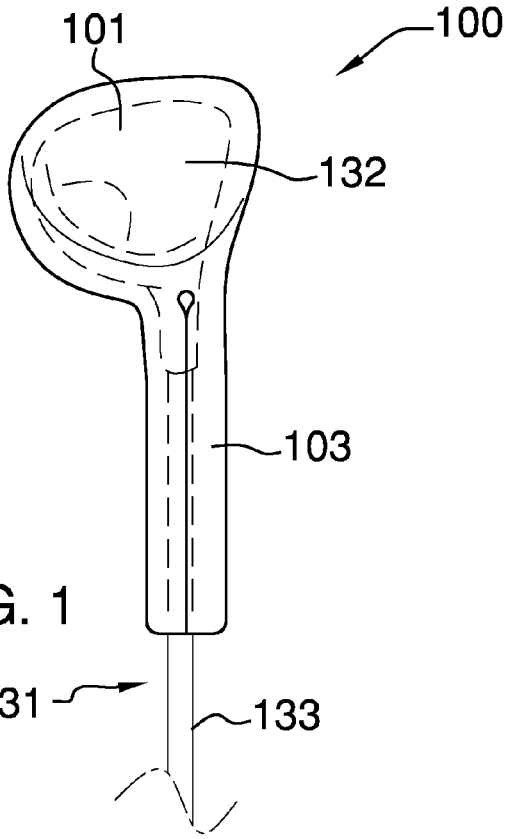
FIG. 1 is a front view of an embodiment of the disclosure.
Figure 2:
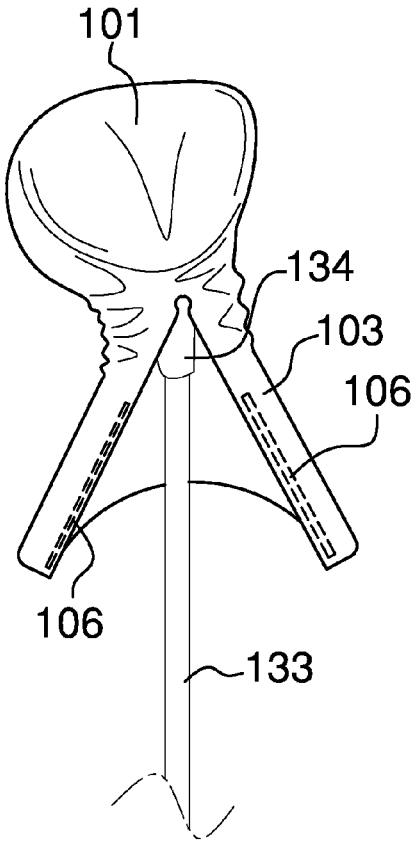
FIG. 2 is an open view of an embodiment of the disclosure.
Figure 3:
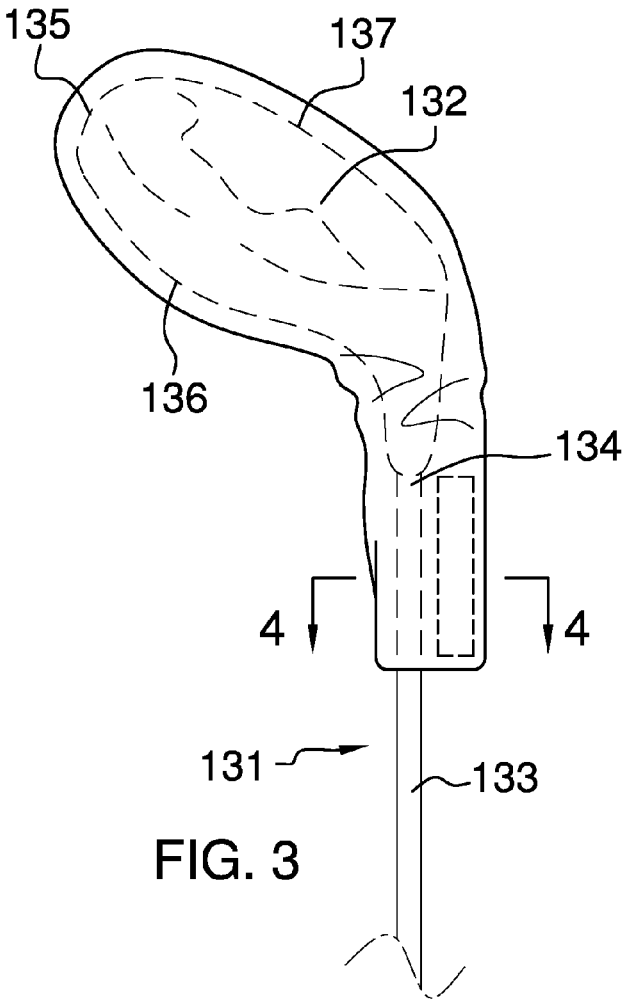
FIG. 3 is a side view of an embodiment of the disclosure.
Figure 4:
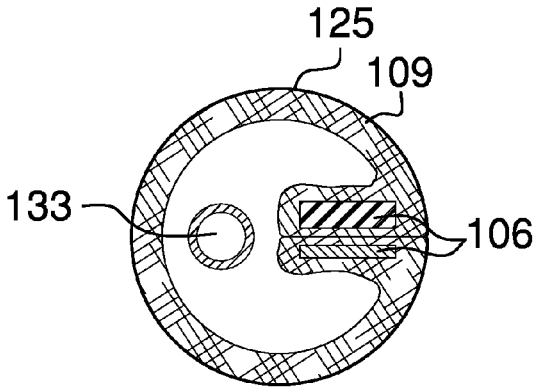
FIG. 4 is a cross-sectional view of an embodiment of the disclosure across 4-4.
Figure 5:
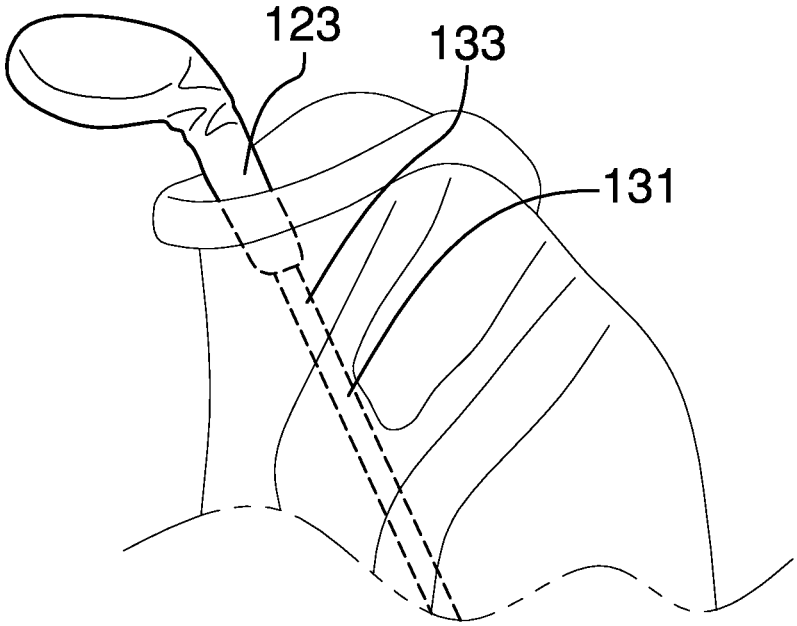
FIG. 5 is an in use view of an embodiment of the disclosure.
Figure 6:
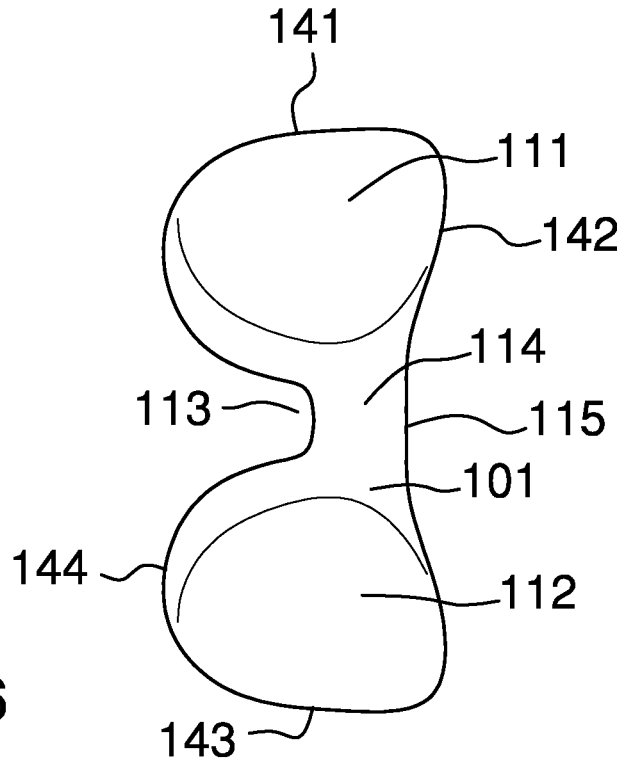
FIG. 6 is a detail view of an embodiment of the disclosure.
Figure 7:
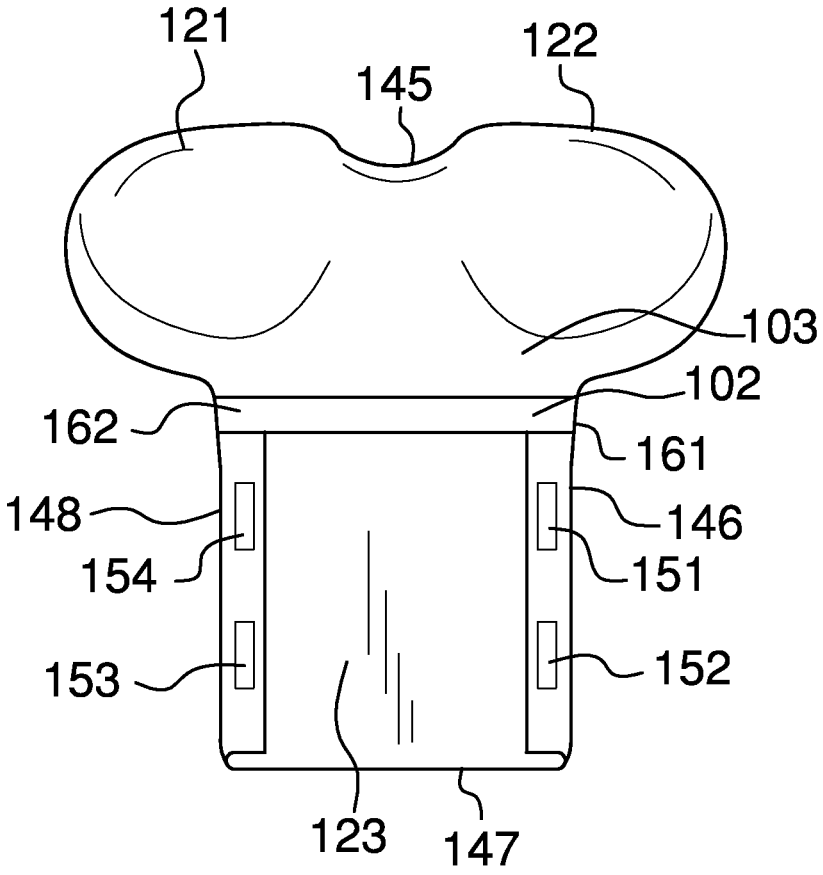
FIG. 7 is a detail view of an embodiment of the disclosure.

Detailed reference will now be made to a first potential embodiment of the disclosure, which is illustrated in FIGS. 1 through 7. The golf club cover 100 (hereinafter invention) comprises a head piece 101, an elastic band 102, and a shaft padding 103. The head piece 101 is an irregularly shaped pattern formed of a composite textile 109. The shaft padding 103 is an irregularly shaped pattern formed of a composite textile 109. The composite textile 109 used in the head piece 101 is the same as the composite textile 109 used in the shaft padding 103. The elastic band 102 is a webbing that is further defined with a first end 161 and a second end 162. The head piece 101 is sewn to the shaft padding 103 to build the invention 100. The elastic band 102 is sewn to the shaft padding 103 in such a way as to position the elastic band 102 at the hosel 134. The elastic band 102 is used to hold the invention 100 securely around the golf club head 132.

The composite textile 109 comprises an outer layer 125 and an inner layer 126. The outer layer 125 is a textile material that is impermeable to water and is used to protect the golf club 131 from getting wet. The inner layer 126 is a textile material that is used to protect the golf club head 132 and the golf club shaft 133 from scratches and other damage. The composite textile 109 can be formed as a single textile or can be two individual textiles that are sewn, glued, or otherwise joined together.

The head piece 101 further comprises a first lobe 111, a second lobe 112, a cut out 113 and a connector 114. The headpiece is further defined with a first side 141, a second side 142, a third side 143, and a fourth side 144. The first lobe 111 is proximal to the first side 141. The second lobe 112 is proximal to the third side 143. The first side 141 and the third side 143 are cut to follow the shape of the toe 135 of the golf club head 132. The cut out 113 is formed in the fourth side 144 of the head piece 101. The first lobe 111 is formed along the first side 141, second side 142, and fourth side 144 to fit around the crown 136 of the golf club 131. The second lobe 112 is formed around the second side 142, the third side 143 and the fourth side 144 to fit around the heel 137 of the golf club 131. The fitting of the first lobe 111 and the second lobe 112 around the golf club head 132 creates a concave shape 115 along the second side 142. The connector 114 is the strip of material that connects the first lobe 111 to the second lobe 112.

The shaft padding 103 further comprises a first flap 121, a second flap 122, and a body 123. The shaft padding 103 is further defined with a fifth side 145, a sixth side 146, a seventh side 147 and an eighth side 148. The first flap 121 is cut into the fifth side 145 and the eighth side 148 of the shaft padding 103. The second flap 122 is cut into the fifth side 145 and the sixth side 146 of the shaft padding 103. The body 123 comprises the portion of the shaft padding 103 that excluded the first flap 121 and the second flap 122. The first flap 121 is cut such that its shape corresponds to the cut out 113 of the head piece 101 such that the first flap 121 can be sewn to the cut out 113. The second flap 122 is cut such that its shape corresponds to the concave shape 115 such that the second flap 112 can be sewn to the concave shape 115.

The elastic band 102 is sewn to the shaft padding 103 at the location where the first flap 121 and the second flap 122 transition to the body 123 of the shaft padding 103. The elastic band 102 is sewn to the shaft padding 103 while under tension so that the sixth side 146 and the eighth side 148 of the shaft padding 103 are pulled together when the tension on the elastic band 102 is released.

The sixth side 146 and the eighth side 148 are fitted with a plurality of magnets 106. The purpose of the plurality of magnets 106 is to join the sixth side 146 and the eighth side 148 of the shaft padding 103 to tightly enclose and protect the golf club shaft 133. The plurality of magnets 106 can be attached to the shaft padding 103 using glue or, alternatively, the plurality of magnets 106 can be placed in pockets sewn into the sixth side 146 and the eighth side 148 of the shaft padding 103. In the first potential embodiment of the disclosure, the plurality of magnets 106 comprises a first magnet 151, a second magnet 152, a third magnet 153 and a fourth magnet 154.

To assemble the invention 100, the elastic band 102 is placed under tension and sewn to the body 123 of the shaft padding 103. The first flap 121 is then sewn into the cut out 113 and the second flap 122 is sewn into the concave shape 115. The first magnet 151, the second magnet 152, the third magnet 153 and the fourth magnet 154 are attached to body 123. The first end 161 of the elastic band 102 is sewn to the second end 162 of the elastic band 102.

To use the invention 100, the golf club head 132 is pushed through the loop formed by the elastic band 102. The body 123 of the shaft padding 103 is allowed to drape around the golf club shaft 133 and is closed together using the plurality of magnets 106.

The following definitions were used in this disclosure:

Composite Textile: As used in this disclosure, a composite textile is a multilayer fabric made of two or more joined layers of textile or sheeting materials.

Crown: As used in this disclosure, the crown is the portion of a golf club head that is furthest from the ground when the golf club is in contact with the golf ball.

Elastic: As used in this disclosure, an elastic is a material or object that deforms when a force is applied to it and that is able to return to its original shape after the force is removed.

Elastic band: As used in this disclosure, an elastic band is a textile that is formed using elastic material that can stretched. Alternatively, the elastic band can be a sheeting that is formed from latex, spandex, or an elastic plastic film that can be stretched.

Heel: As used in this disclosure, the heel is the portion of a golf club head that is closest from the ground when the golf club is in contact with the golf ball.

Hosel: As used in this disclosure, the hosel is the socket of a golf club head into which the golf club shaft is inserted.

Sheeting: As used in this disclosure, sheeting is a material, such as cloth or plastic, in the form of a thin flexible layer or layers that is used to cover something.

Textile: As used in this disclosure, a textile is a material that is woven, knitted, or felted. Synonyms in common usage for this definition include fabric and cloth.

Toe: As used in this disclosure, the toe is the part, of a golf club head that is furthest from the hosel.

Webbing: As used in this disclosure, a webbing is strong, close woven or knitted fabric that is used for straps or belting.

With respect to the above description, it is to be realized that the optimum dimensional relationship for the various components of the invention described above and in FIGS. 1 through 7, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A cover comprising:

a head piece, an elastic band, and a shaft padding;

wherein the cover is adapted for use with a golf club, wherein the cover has a golf club head portion;

wherein the cover has a shaft portion;

wherein the cover is secured to the golf club using a plurality of magnets;

wherein the head piece is formed of a composite textile;

wherein the shaft padding is formed of a composite textile;

wherein the same composite textile is used in the head piece and the shaft padding;

wherein the elastic band is a webbing that is further defined with a first end and a second end;

wherein the head piece is joined to the shaft padding;

wherein the composite textile comprises an outer layer and an inner layer;

wherein the outer layer is a textile material that is impermeable to water;

wherein the head piece further comprises a first lobe, a second lobe, a cut out, a connector, and a concave shape;

wherein the shaft padding further comprises a first flap, a second flap, and a body;

wherein the plurality of magnets further comprises a first magnet, a second magnet, a third magnet and a fourth magnet.

2. The cover according to claim 1 wherein the shaft padding is fitted with the plurality of magnets.

3. The cover according to claim 2 wherein the first flap is then joined to the cut out;

wherein the second flap is joined to the concave shape.

* * * * *